US010610002B2

(12) United States Patent
Pacha et al.

(10) Patent No.: US 10,610,002 B2
(45) Date of Patent: Apr. 7, 2020

(54) GOLF BAG STRAP SYSTEMS AND METHODS TO MANUFACTURE GOLF BAG STRAP SYSTEMS

(71) Applicant: Parsons Xtreme Golf, LLC, Scottsdale, AZ (US)

(72) Inventors: Duane E. Pacha, Chandler, AZ (US); Candace Chen, Phoenix, AZ (US); William W. Sliger, II, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 16/050,260

(22) Filed: Jul. 31, 2018

(65) Prior Publication Data

US 2019/0029403 A1 Jan. 31, 2019

Related U.S. Application Data

(63) Continuation-in-part of application No. 29/634,924, filed on Jan. 25, 2018, now Pat. No. Des. 844,994, which is a continuation-in-part of application No. 29/612,038, filed on Jul. 27, 2017, now abandoned.

(60) Provisional application No. 62/539,640, filed on Aug. 1, 2017.

(51) Int. Cl.

| | |
|---|---|
| ***A45F 3/14*** | (2006.01) |
| ***A44B 11/00*** | (2006.01) |
| ***A45F 3/04*** | (2006.01) |
| ***A63B 55/00*** | (2015.01) |

(52) U.S. Cl.

CPC ..... *A45F 3/14* (2013.01); *A44B 11/00* (2013.01); *A45F 3/04* (2013.01); *A45F 2003/142* (2013.01); *A63B 55/408* (2015.10)

(58) Field of Classification Search

CPC ..... A44B 11/00; A45F 3/04
USPC ..... 224/604, 257, 259; 2/230; 24/315
See application file for complete search history.

(56) References Cited

U.S. PATENT DOCUMENTS

| | | | | |
|---|---|---|---|---|
| 1,365,493 A * | 1/1921 | Hedger | ..... | A41F 3/00 24/315 |
| 1,419,802 A * | 6/1922 | Bear | ..... | A41F 3/00 24/315 |
| 1,697,363 A * | 1/1929 | Losey | ..... | A47D 15/006 297/484 |

(Continued)

FOREIGN PATENT DOCUMENTS

| | | | | |
|---|---|---|---|---|
| GB | 2481325 A * | 12/2011 | ..... | A47D 13/025 |

*Primary Examiner* — Nathan J Newhouse
*Assistant Examiner* — Lester L Vanterpool

(57) ABSTRACT

Golf bag strap systems and methods to manufacture the same are generally described herein. In one example, a strap system may include a strap connector having a body portion. A first strap arm portion may extend from the body portion and may have a first channel extending through the body portion and configured to receive a first strap. A second strap arm portion may extend from the body portion and may have a second channel extending through the body portion and configured to receive a second strap. The first and second channels may be at least partially separate from each other. The first and second straps may freely move relative to each other without contacting each other inside the strap connector. Other examples may be described and claimed.

18 Claims, 8 Drawing Sheets

(56) References Cited

U.S. PATENT DOCUMENTS 2,551,165 A * 5/1951 Rochat ..... A44B 11/00 24/163 R
2,835,010 A * 5/1958 Bayon ..... A41F 11/00 24/315
3,739,961 A * 6/1973 Soukeras ..... A45C 1/04 224/579
4,749,113 A * 6/1988 Grubman ..... A45C 1/04 2/300
5,205,450 A * 4/1993 Derosier ..... A47D 13/025 224/161
5,211,321 A * 5/1993 Rodriguez ..... A41D 13/0012 2/102
D411,039 S * 6/1999 Reimers ..... 224/645
6,152,342 A * 11/2000 Suk ..... A63B 55/408 224/259
6,253,874 B1 * 7/2001 Casebolt ..... A62B 35/0031 182/3
6,530,129 B1 * 3/2003 Cheng ..... A45F 3/14 24/200
6,988,644 B1 * 1/2006 Asherbranner ..... A47D 13/025 224/160
7,370,781 B2 * 5/2008 Gambrill ..... A45F 5/00 224/583
8,967,439 B2 * 3/2015 Vitangcol ..... A45F 3/04 224/259
9,198,525 B2 * 12/2015 Wernick ..... A47D 13/025
D810,443 S * 2/2018 Burgess ..... D3/318
10,245,486 B2 * 4/2019 Burgess ..... A63B 55/408
10,449,429 B2 * 10/2019 Bruce ..... A63B 55/408
2002/0175194 A1 * 11/2002 Norman ..... A47D 13/025 224/160
2005/0067221 A1 * 3/2005 Wolner ..... A62B 35/0031 182/3
2005/0205356 A1 * 9/2005 Velasco, Jr. ..... A62B 35/0037 182/3
2007/0209868 A1 * 9/2007 Betcher ..... A62B 35/0025 182/3
2008/0156839 A1 * 7/2008 Betcher ..... A45F 3/14 224/630
2012/0267410 A1 * 10/2012 Loudenslager ..... A63B 55/00 224/627
2015/0136825 A1 * 5/2015 Kalck ..... A45F 3/047 224/653

* cited by examiner

GOLF BAG STRAP SYSTEMS AND METHODS TO MANUFACTURE GOLF BAG STRAP SYSTEMS

CROSS REFERENCE

This application claims the benefit of U.S. Provisional Application No. 62/539,640, filed Aug. 1, 2017. This application is a continuation-in-part of application Ser. No. 29/634,924, filed Jan. 25, 2018, which is a continuation-in-part of application Ser. No. 29/612,038, filed Jul. 27, 2017, now abandoned. The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to bag straps, and more particularly, to golf bag strap systems and methods to manufacture golf bag strap systems.

BACKGROUND

A golf bag may be carried by an individual with one or more carry straps attached to the golf bag. The golf bag may hold golf clubs, golf balls, and golf accessories.

Figure 1:
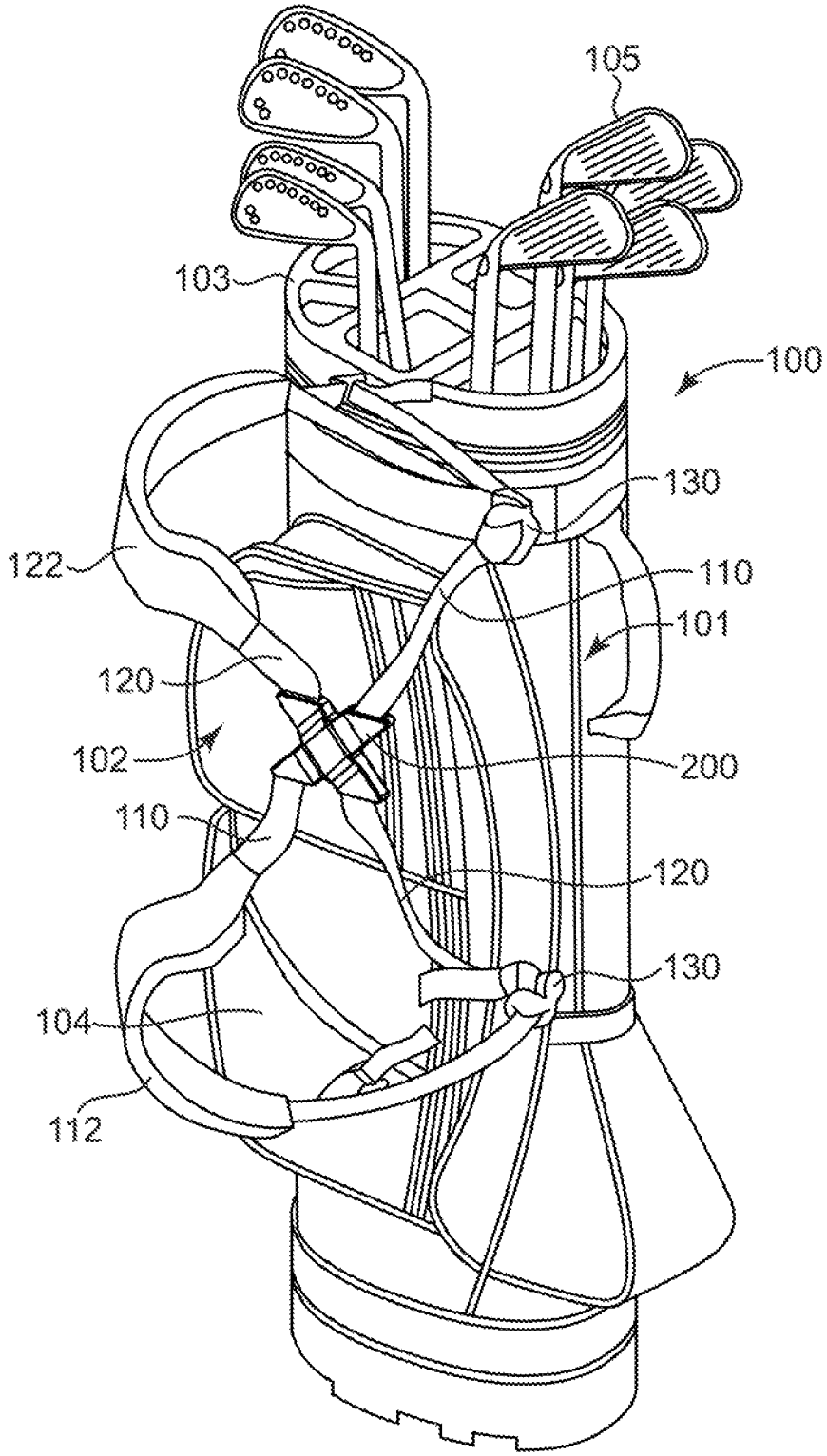
FIG. 1 depicts a perspective view of a golf bag according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf bag strap systems and methods to manufacture golf bag strap systems are described herein. The apparatus, methods, and articles of manufacture described herein are not limited in this regard.

Figure 2:
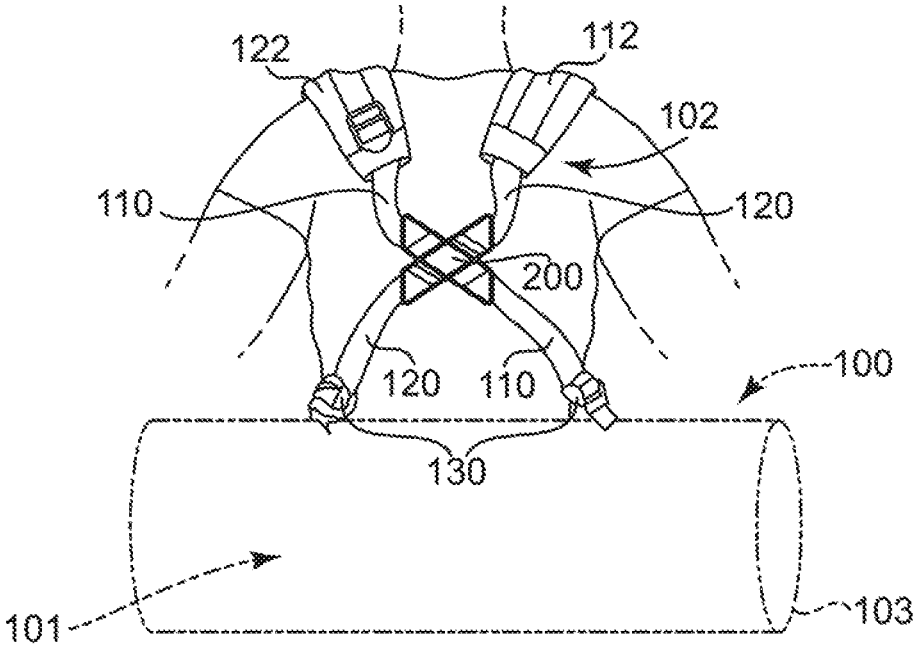
FIG. 2 depicts a perspective view of a golf bag strap system according to an embodiment of the apparatus, methods, and articles of manufacture described herein.
Figure 3:
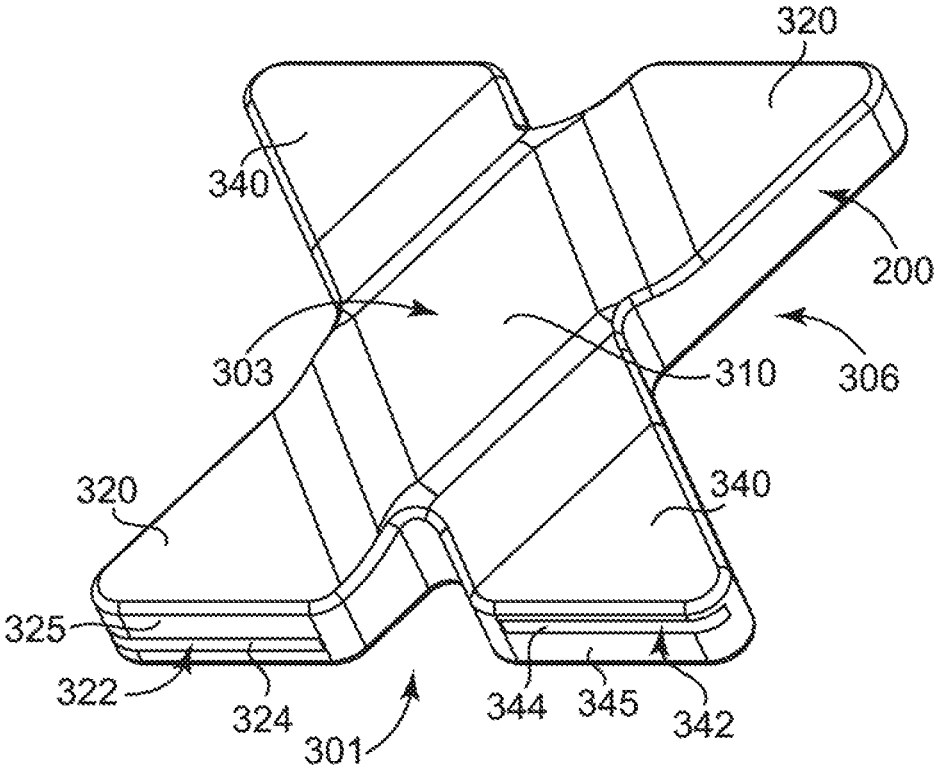
FIG. 3 depicts a perspective view of a strap connector according to an embodiment of the apparatus, methods, and articles of manufacture described herein.

In one example, as shown in FIGS. 1 and 2, a golf bag 100 may include a bag body portion 101 and a strap system 102 coupled to the bag body portion 101. The bag body portion 101 may receive one or more golf clubs 105 through a top end portion 103 and may include one or more compartments 104 for storing golf balls, golf accessories, personal items, etc. The strap system 102 may include a first strap 110, a second strap 120, and a strap connector 200. The first strap 110 and the second strap 120 may be connected to the bag body portion 101 and may cross over each other inside the strap connector 200. The first strap 110 and the second strap 120 may move freely in the strap connector 200 relative to each other and without contacting each other to self-adjust the location of the strap connector 200, and hence the configuration of the strap system 102, without any manual adjustment by an individual using the golf bag 100. The first strap 110 and the second strap 120 may include respective integrated padding 112 and 122, movable pads or cushions (not shown), and/or one or more buckles (generally shown as buckles 130) for adjusting the length of the first strap 110 and/or the second strap 120. The ends of the first strap 110 and/or the second strap 120 may be fixedly or movably (e.g., pivotally) attached to the golf bag 100. The apparatus, methods, and articles of manufacture described herein are not limited in this regard.

In one example, as shown in FIGS. 3-9, the strap connector 200 may include a front portion 301, a rear portion 302, a top portion 303, a bottom portion 304, and opposing side portions 305 and 306. The strap connector 200 may include a body portion 310, a first strap arm portion 320 extending diagonally relative to the body portion 310, and a second strap arm portion 340 extending diagonally relative to the body portion 310. The first strap arm portion 320 may be transverse to the second strap arm portion 340. The first strap arm portion 320 and the second strap arm portion 340 may define an X-shape configuration, which may be symmetrical or substantially symmetrical relative to a first center axis 512 and a second center axis 514 of the body portion 310. The first center axis 512 may be transverse to the second center axis 514. Accordingly, the strap connector 200 may have vertical and/or horizontal symmetry. The apparatus, methods, and articles of manufacture described herein are not limited in this regard.

Figure 4:
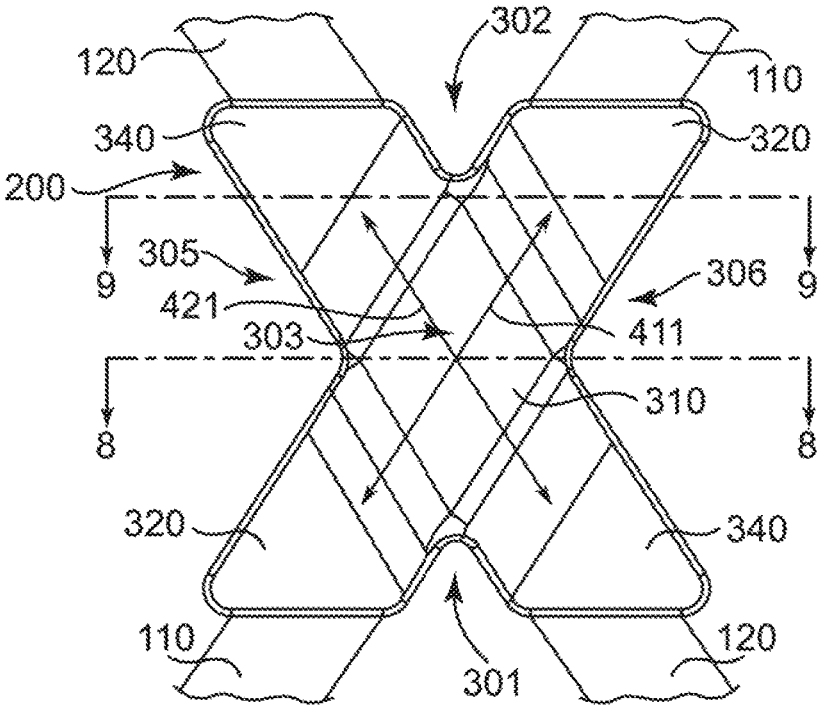
FIG. 4 depicts a top view of the strap connector of FIG. 3.
Figure 5:
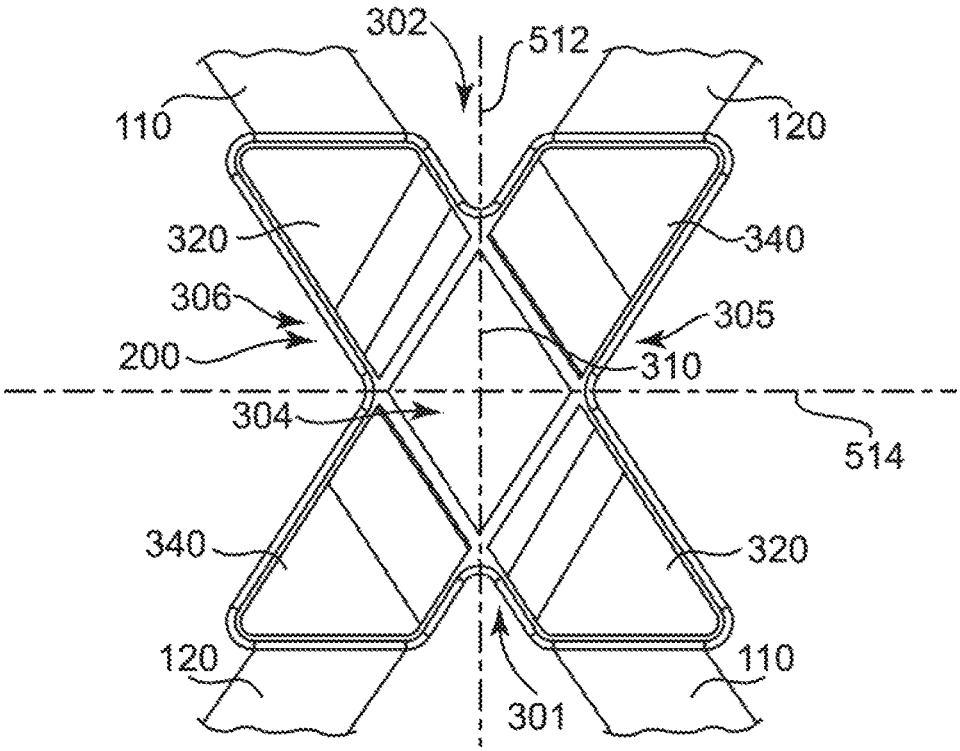
FIG. 5 depicts a bottom view of the strap connector of FIG. 3.
Figure 6:
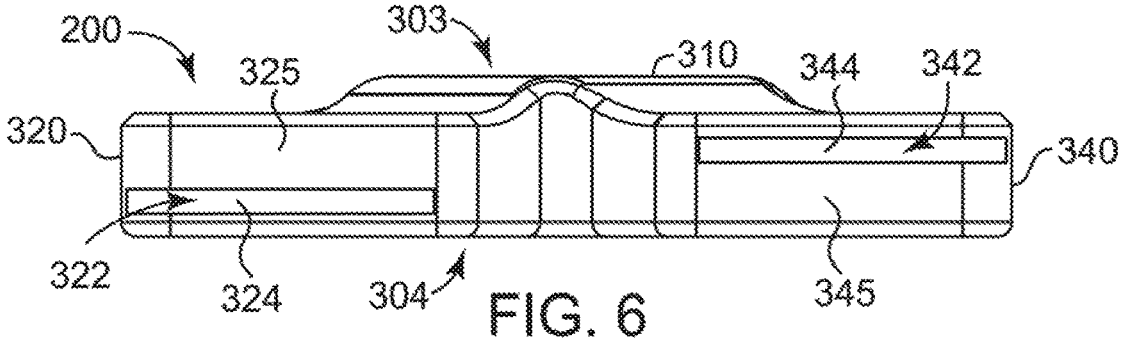
FIG. 6 depicts a front side view of the strap connector of FIG. 3.
Figure 7:
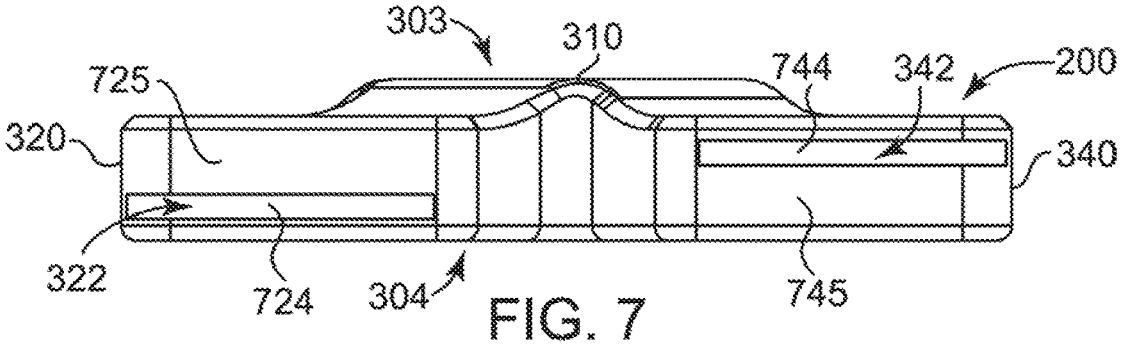
FIG. 7 depicts a rear side view of the strap connector of FIG. 3.
Figure 8:
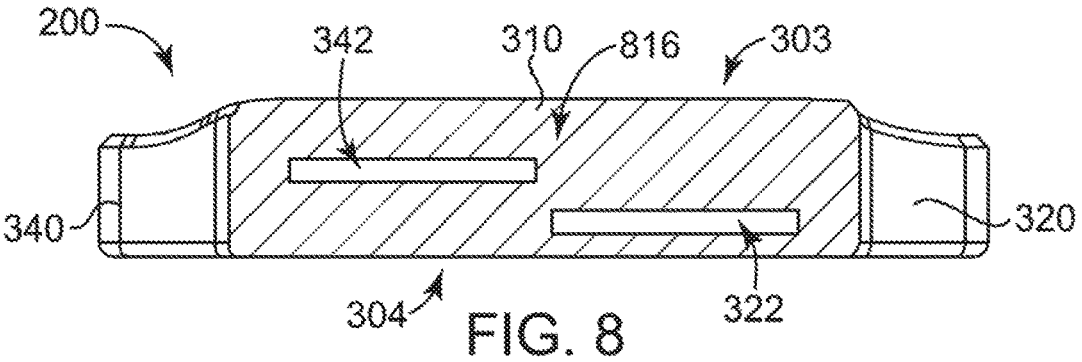
FIG. 8 is a cross sectional view of the strap connector of FIG. 3 taken at line 8-8 of FIG. 4.
Figure 9:
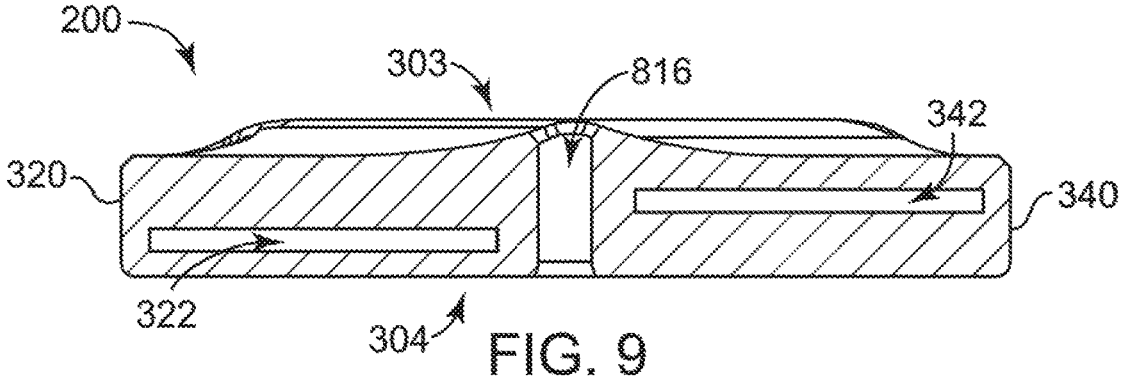
FIG. 9 is a cross sectional view of the strap connector of FIG. 3 taken at line 9-9 of FIG. 4.
Figure 10:
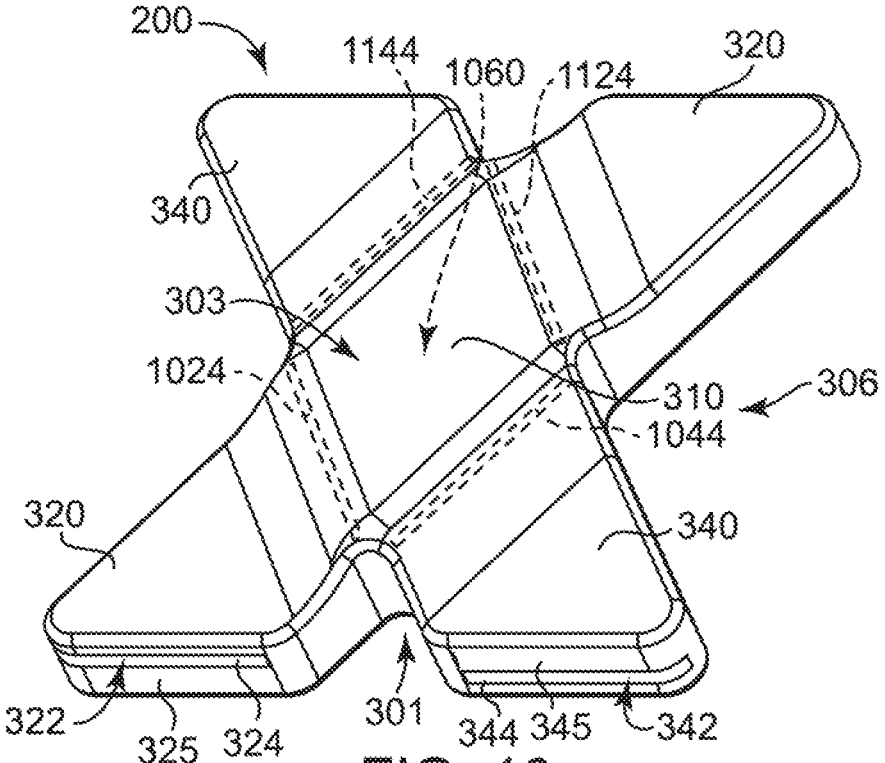
FIG. 10 depicts a perspective view of a strap connector according to an embodiment of the apparatus, methods, and articles of manufacture described herein.

In one example, as shown in FIGS. 3-9, the first strap arm portion 320 may include a first channel 322 extending through the entire length of the first strap arm portion 320. The first channel 322 may be substantially straight and may include a first opening 324 at a first longitudinal end 325 of the first strap arm portion 320 and a second opening 724 at a second and opposite longitudinal end 725 of the first strap arm portion 320. The first opening 324 and/or the second opening 724 may have any shape. The first and second openings 324 and 724 may be slits positioned between the top portion 303 and the bottom portion 304 of the strap connector 200. The first and second openings 324 and 724 may extend across the respective first and second longitudinal ends 325 and 725 in a sideways direction toward a corresponding one of the opposing side portions 305 and 306 of the strap connector 200. The first and second openings 324 and 724 may be similar in size and may be located at similar vertical positions (i.e., vertically aligned) on the first and second longitudinal ends 325 and 725 of the first strap arm portion 320, respectively. Accordingly, the first and second openings 324 and 724 may visually coincide if the first strap arm portion 320 is viewed in a longitudinal direction from the first longitudinal end 325 to the second longitudinal end 725, or vice versa, as generally indicated in FIG. 4 by bidirectional arrow 411. The apparatus, methods, and articles of manufacture described herein are not limited in this regard.

In one example, as shown in FIGS. 3-9, the first channel 322 may be a closed channel except for the first opening 324 and the second opening 724. The first channel 322, including the first opening 324 and the second opening 724, may have a width that is greater than the width of the first strap 110 and a height that is greater than the thickness of the first strap 110. Accordingly, any portion of the first strap 110 may move or slide freely inside the first channel 322 in either direction generally indicated by bidirectional arrow 411. The interior walls of the first channel 322 may have a smooth surface or be constructed from a low friction material so as to not hinder the free movement of the first strap 110 inside the first channel 322. The apparatus, methods, and articles of manufacture described herein are not limited in this regard.

In one example, as shown in FIGS. 3-9, the second strap arm portion 340 may include a second channel 342 extending through the entire length of the second strap arm portion 340. The second channel 342 may be substantially straight and may include a first opening 344 at a first longitudinal end 345 of the second strap arm portion 340 and a second opening 744 at a second and opposite longitudinal end 745 of the second strap arm portion 340. The first opening 344 and/or the second opening 744 may have any shape. The first and second openings 344 and 744 may be slits positioned between the top portion 303 and the bottom portion 304 of the strap connector 200. The first and second openings 344 and 744 may extend across the respective first and second longitudinal ends 345 and 745 in a sideways direction toward a corresponding one of the opposite side portions 305 and 306 of the strap connector 200. The first and second openings 344 and 744 may be similar in size and may be located at similar vertical positions (i.e., vertically aligned) on the first and second longitudinal ends 345 and 745 of the second strap arm portion 340, respectively. Accordingly, the first and second openings 344 and 744 may visually coincide if the second strap arm portion 340 is viewed in a longitudinal direction from the first longitudinal end 345 to the second longitudinal end 745, or vice versa, as generally indicated in FIG. 4 by bidirectional arrow 421. The apparatus, methods, and articles of manufacture described herein are not limited in this regard.

The second channel 342 may be a closed channel except for the first opening 344 and the second opening 744. The second channel 342, including the first opening 344 and the second opening 744, may have a width that is greater than the width of the second strap 120 and a height that is greater than the thickness of the second strap 120. Accordingly, any of the second strap 120 can move or slide freely inside the second channel 342 in either direction generally indicated by bidirectional arrow 421. The interior walls of the second channel 342 may have a smooth surface or be constructed from a low friction material so as to not hinder the free movement of the second strap 120 inside the second channel 342. The apparatus, methods, and articles of manufacture described herein are not limited in this regard.

In one example, as shown in FIGS. 3-9, the first channel 322 and the second channel 342 may be vertically offset from each other with respect to their distances relative the top and bottom portions 303 and 304 of the strap connector 200. For example, the vertical position at which the first and second openings 324 and 724 of the first channel 322 are located on the first strap arm portion 320 may be lower than the vertical position at which the first and second openings 344 and 744 of the second channel 342 are located on the second strap arm portion 340. In other words, the first and second openings 324 and 724 of the first channel 322 may be closer to the bottom portion 304 of the strap connector 200 compared to the first and second openings 344 and 744 of the second channel 342. Accordingly, the first channel 322 containing the first strap 110 may extend through the body portion 310 below the second channel 342 containing the second strap 120. Alternatively, the first and second channels 322 and 342 may be vertically offset such that the first channel 322 extends through the body portion 310 above the second channel 342. The apparatus, methods, and articles of manufacture described herein are not limited in this regard.

In one example, as shown in FIGS. 3-9, the body portion 310 may include a center portion 816 that separates the first channel 322 and the second channel 342. Accordingly, the first strap 110 and the second strap 120 may be prevented from contacting each other by virtue of separate strap pathways through the first strap arm portion 320, the body portion 310, and the second strap arm portion 340. Thus, the first strap 110 and the second strap 120 may freely move or slide in the first channel 322 and the second channel 342, respectively, without any hindrance or any contact with each other. The apparatus, methods, and articles of manufacture described herein are not limited in this regard.

In one example, as shown in FIGS. 10-17, the strap connector 200 is generally similar to the one shown in FIGS. 3-9 with a few exceptions as described below. Accordingly, similar parts of the strap connector 200 of FIGS. 10-17 and FIGS. 3-9 are denoted with the same reference numbers. For example, the vertical position at which the first and second openings 324 and 724 of the first channel 322 are located on the first strap arm portion 320 may be higher than the vertical position at which the first and second openings 344 and 744 of the second channel 342 are located on the second strap arm portion 340. Accordingly, the first channel 322 and the first strap 110 may extend through the body portion 310 above the second channel 342 and the second strap 120. Alternatively, the first and second channels 322 and 342 may be vertically offset such that the first channel 322 and the first strap 110 extend through the body portion 310 below the second channel 342 and the second strap 120. The apparatus, methods, and articles of manufacture described herein are not limited in this regard.

Figure 11:
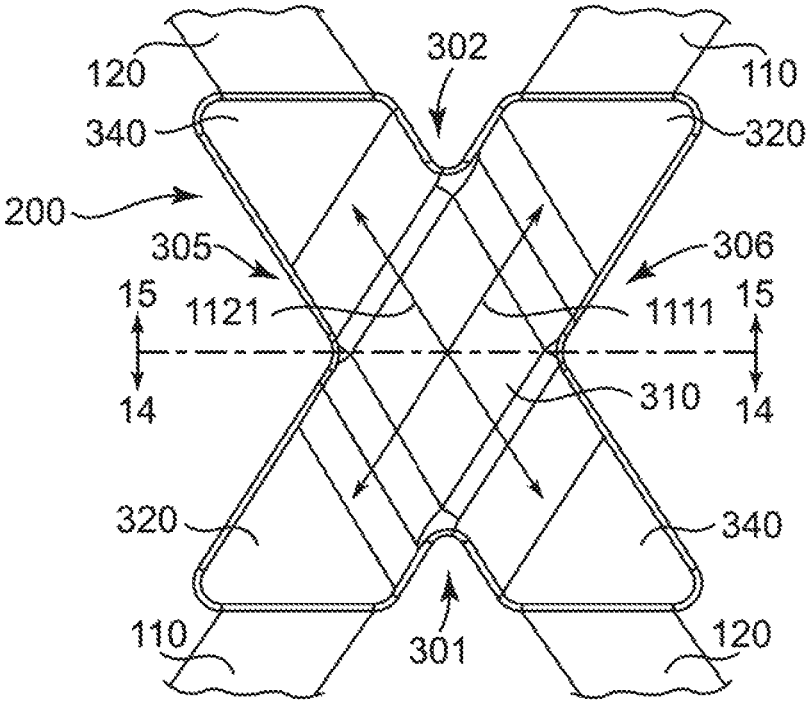
FIG. 11 depicts a top view of the strap connector of FIG. 10.
Figure 12:
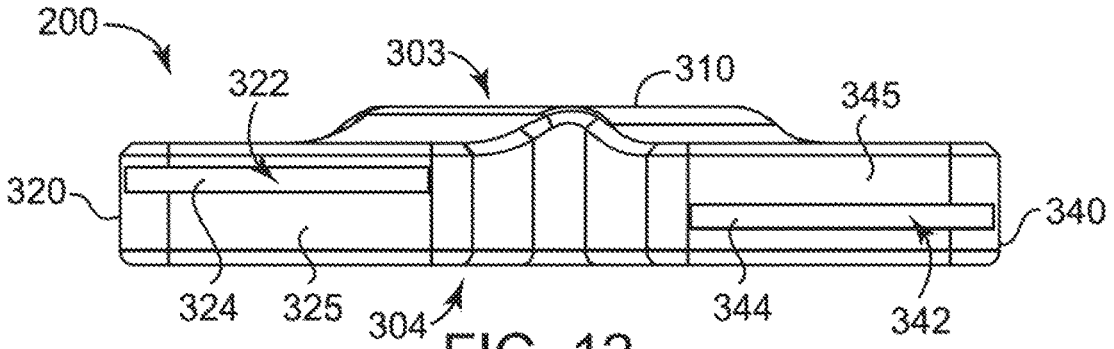
FIG. 12 depicts a front side view of the strap connector of FIG. 10.
Figure 13:
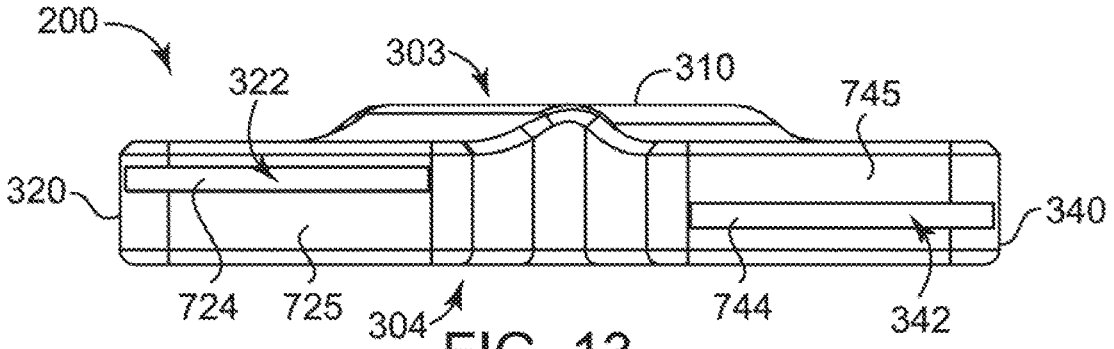
FIG. 13 depicts a rear side view of the strap connector of FIG. 10.
Figure 14:
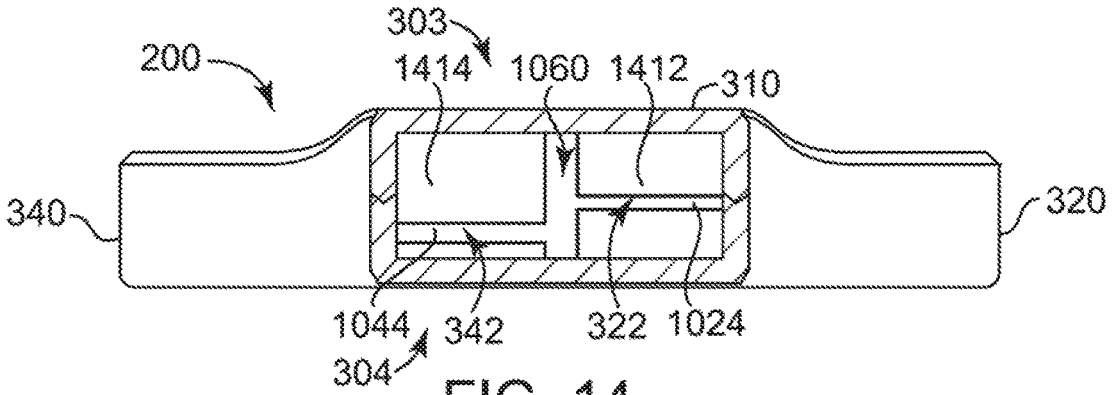
FIG. 14 depicts a cross sectional view of the strap connector of FIG. 10 taken at line 14 of FIG. 11.
Figure 15:
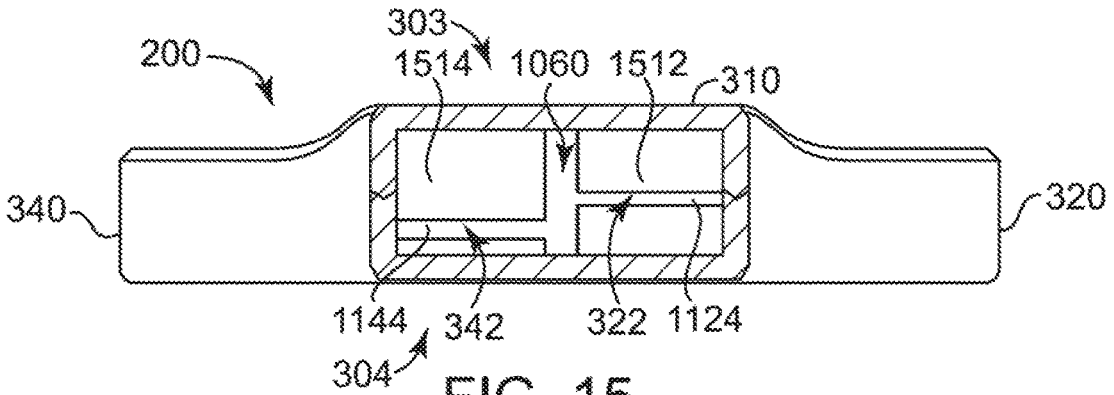
FIG. 15 depicts a cross sectional view of the strap connector of FIG. 10 taken at line 15 of FIG. 11.
Figure 16:
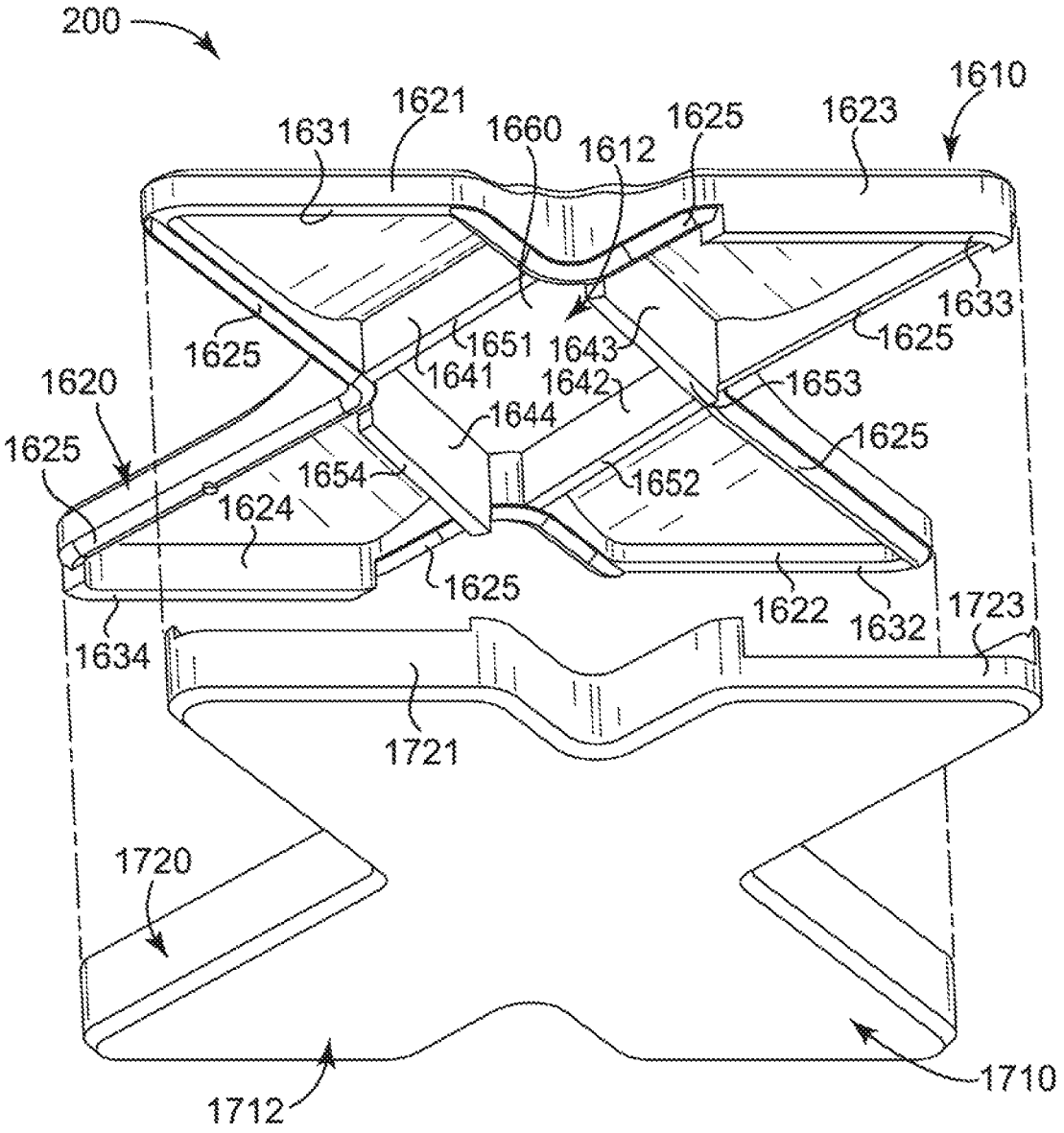
FIG. 16 depicts a bottom exploded view of the strap connector of FIG. 10.

In one example, as shown in FIGS. 10-17, the first channel 322 may include one or more openings other than the first opening 324 and the second opening 724. The one or more openings may have any shape. In one example, the first channel 322 may include a third opening 1024 and a fourth opening 1124 inside the strap connector 200 at or proximate the body portion 310. The third opening 1024 may be a slit positioned between the top and bottom portions 303 and 304 of the strap connector 200. The third opening 1024 may be at a first interior sidewall 1412 of the body portion 310 and may extend between the front and side portions 301 and 305 of the strap connector 200. The fourth opening 1124 may be a slit positioned between the top and bottom portions 303 and 304 of the strap connector 200. The fourth opening 1124 may be at a second interior sidewall 1512 of the body portion 310 and may extend between the rear and side portions 302 and 306. In one example, the third and fourth openings 1024 and 1124 of the first channel 322 may be generally aligned with each other and may be substantially parallel, parallel, or non-parallel to each other. The third and fourth openings 1024 and 1124 may be generally aligned with the first and second openings 324 and 724 of the first channel 322 and may be substantially parallel, parallel, or non-parallel thereto. The third and fourth openings 1024 and 1124 may be similar in size and may have similar vertical positions (i.e., vertically aligned) as the first and second openings 324 and 724 of the first channel 322. Accordingly, the first, second, third, and fourth openings 324, 724, 1024, and 1124 of the first channel 322 may visually coincide if the first strap arm portion 320 is viewed in a longitudinal direction from the first longitudinal end 325 to the second longitudinal end 725, or vice versa, as generally indicated in FIG. 11 by bidirectional arrow 1111. The apparatus, methods, and articles of manufacture described herein are not limited in this regard.

In one example, as shown in FIGS. 10-17, the first channel 322, including the first, second, third, and fourth openings 324, 724, 1024, and 1124, may have a width that is greater than the width of the first strap 110 and a height that is greater than the thickness of the first strap 110. Accordingly, any portion of the first strap 110 may move or slide freely inside the first channel 322 in either direction generally indicated by bidirectional arrow 1111. The interior walls of the first channel 322 may have a smooth surface or be constructed from a low friction material so as to not hinder the free movement of the first strap 110 inside the first channel 322. The apparatus, methods, and articles of manufacture described herein are not limited in this regard.

In one example, as shown in FIGS. 10-17, the second channel 342 may include one or more openings other than the first opening 344 and the second opening 744. The one or more openings may have any shape. In one example, the second channel 342 may include a third opening 1044 and a fourth opening 1144 inside the strap connector 200 at or proximate the body portion 310. The third opening 1044 may be a slit positioned between the top and bottom portions 303 and 304 of the strap connector 200. The third opening 1044 may be at a third interior sidewall 1414 of the body portion 310 and may extend between the front and side portions 301 and 306 of the strap connector 200. The fourth opening 1144 may be a slit positioned between the top and bottom portions 303 and 304 of the strap connector 200. The fourth opening 1144 may be at a fourth interior sidewall 1514 of the body portion 310 and may extend between the rear and side portions 302 and 305 of the strap connector 200. In one example, the third and fourth openings 1044 and 1144 of the second channel 342 may be generally aligned and may be substantially parallel, parallel, or non-parallel to each other. The third and fourth openings 1044 and 1144 may be generally aligned with the first and second openings 344 and 744 of the second channel 342 and may be substantially parallel, parallel, or non-parallel thereto. Additionally, the third and fourth openings 1044 and 1144 of the second channel 342 may each be adjacent the third and fourth openings 1024 and 1124 of the first channel 322. The third and fourth openings 1044 and 1144 may be similar in size and may have similar vertical positions (i.e., vertically aligned) as the first and second openings 344 and 744 of the second channel 342. Accordingly, the first, second, third, and fourth openings 344, 744, 1044, and 1144 of the second channel 342 may visually coincide if the second strap arm portion 340 is viewed in a longitudinal direction from the first longitudinal end 345 to the second longitudinal end 745, or vice versa, as generally indicated in FIG. 11 by bidirectional arrow 1121. The apparatus, methods, and articles of manufacture described herein are not limited in this regard.

In one example, as shown in FIGS. 10-17, the second channel 342, including the first, second, third, and fourth openings 344, 744, 1044, and 1144, may have a width that is greater than the width of the second strap 120 and a height that is greater than the thickness of the second strap 120. Accordingly, any portion of the second strap 120 may move or slide freely inside the second channel 342 in either direction generally indicated by bidirectional arrow 1121. The interior walls of the second channel 342 may have a smooth surface or be constructed from a low friction material so as to not hinder the free movement of the second strap 120 inside the second channel 342. The apparatus, methods, and articles of manufacture described herein are not limited in this regard.

In one example, as shown in FIGS. 10-17, the first and second channels 322 and 342 may be closed off or separate from each other except for inside an interior space 1060 of the body portion 310. Accordingly, the first and second straps 110 and 120 may be contained separately within the first and second strap arm portions 320 and 340, respectively, and may share the interior space 1060 of the body portion 310. As described herein, the first and second channels 322 and 342 may be vertically offset from each other inside the body portion 310. Accordingly, despite sharing the interior space 1060 of the body portion 310, the first and second straps 110 and 120 may be suspended inside the body portion 310 at different vertical positions, and hence, may freely move relative to each other without contacting each other inside the body portion 310. For example, the first strap 110 may be suspended above or below the second strap 120 depending on the relative vertical offset between the first and second channels 322 and 342. The apparatus, methods, and articles of manufacture described herein are not limited in this regard.

In one example, as shown in FIGS. 10-17, the strap connector 200 may be assembled from a top piece 1610 and a bottom piece 1710. The top piece 1610 may substantially define an upper portion or upper half of the strap connector 200. The top piece 1610 may include a top portion 1612 and a top peripheral wall 1620 extending downward from the top portion 1612. The top portion 1612 may have an X-shape configuration and the top peripheral wall 1620 may be contoured to the shape of the top portion 1612. With the exception of a first top wall portion 1621, a second top wall portion 1622, a third top wall portion 1623, and a fourth top wall portion 1624, the remaining portions of the top peripheral wall 1620 may include a guide portion 1625 defining a lower extent thereof. The guide portion 1625 may taper away from the remaining portion of the top peripheral wall 1620. The first and second top wall portions 1621 and 1622 may correspond to an upper portion of the first and second longitudinal ends 325 and 725 of the first strap arm portion 320, respectively, whereas the third and fourth top wall portions 1623 and 1624 may correspond to an upper portion of the first and second longitudinal ends 345 and 745 of the second strap arm portion 340, respectively. The first and second top wall portions 1621 and 1622 may have similar lower extents 1631 and 1632, respectively. The lower extents 1631 and 1632 may be flat and may be positioned higher than the guide portion 1625, positioned evenly (e.g., at the same height or substantially the same height) with the guide portion 1625, or positioned lower than the guide portion 1625 based on the desired vertical position and height of the first and second openings 324 and 724 of the first channel 322. The third and fourth top wall portions 1623 and 1624 may have similar lower extents 1633 and 1634, respectively. The lower extents 1633 and 1634 may be flat and may be positioned higher than the guide portion 1625, positioned evenly (e.g., at the same height or substantially the same height) with the guide portion 1625, or positioned lower than the guide portion 1625 based on the desired vertical position and height of the first and second openings 344 and 744 of the second channel 342. The apparatus, methods, and articles of manufacture described herein are not limited in this regard.

In one example, as shown in FIGS. 10-17, the top piece 1610 may also include a first pair of top opposing ribs 1641 and 1642 extending downward from an interior surface 1660 of the top portion 1612 and corresponding to an upper portion of the first and second interior sidewalls 1412 and 1512 of the body portion 310, respectively. The first pair of top opposing ribs 1641 and 1642 may have lower extents 1651 and 1652 positioned evenly (e.g., at the same height or substantially the same height) with the lower extents 1631 and 1632 of the first and second top wall portions 1621 and 1622 of the top peripheral wall 1620. The top piece 1610 may further include a second pair of top opposing ribs 1643 and 1644 extending downward from the interior surface 1660 of the top portion 1612 and corresponding to an upper portion of the third and fourth sidewalls 1414 and 1514 of the body portion 310, respectively. The second pair of top opposing ribs 1643 and 1644 may have lower extents 1653 and 1654 positioned evenly (e.g., at the same height or substantially the same height) with the lower extents 1633 and 1634 of the third and fourth top wall portions 1623 and 1624 of the top peripheral wall 1620. The apparatus, methods, and articles of manufacture described herein are not limited in this regard.

In one example, as shown in FIGS. 10-17, the bottom piece 1710 may substantially define a lower portion or lower half of the strap connector 200. The bottom piece 1710 may include a bottom portion 1712 and a bottom peripheral wall 1720 extending upward from the bottom portion 1712. The bottom portion 1712 may have an X-shape configuration and the bottom peripheral wall 1720 may be contoured to the shape of the bottom portion 1712. With the exception of a first bottom wall portion 1721, a second bottom wall portion 1722, a third bottom wall portion 1723, and a fourth bottom wall portion 1724, remaining portions of the bottom peripheral wall 1720 may include a guide rail portion 1725 defining an upper extent thereof and configured to receive the guide portion 1625 of the top peripheral wall 1620. The first and second bottom wall portions 1721 and 1722 may correspond to a lower portion of the first and second longitudinal ends 325 and 725 of the first strap arm portion 320, respectively, whereas the third and fourth bottom wall portions 1723 and 1724 may correspond to a lower portion of the first and second longitudinal ends 345 and 745 of the second strap arm portion 340, respectively. The first and second bottom wall portions 1721 and 1722 may have similar upper extents 1731 and 1732, respectively. The upper extents 1731 and 1732 may be flat and may be positioned higher than the guide rail portion 1725, positioned evenly with the guide rail portion 1725, or positioned lower than the guide rail portion 1725 based on the desired vertical position and height of the first and second openings 324 and 724 of the first channel 322. The third and fourth bottom wall portions 1723 and 1724 may have similar upper extents 1733 and 1734, respectively. The upper extents 1733 and 1734 may be flat and may be positioned higher than the guide rail portion 1725, positioned evenly (e.g., at the same height or substantially the same height) with the guide rail portion 1725, or positioned lower than the guide rail portion 1725 based on the desired vertical position and height of the first and second openings 344 and 744 of the second channel 342. The apparatus, methods, and articles of manufacture described herein are not limited in this regard.

In one example, as shown in FIGS. 10-17, the bottom piece 1710 may also include a first pair of bottom opposing ribs 1741 and 1742 extending upward from an interior surface 1760 of the bottom portion 1712 and corresponding to a lower portion of the first and second interior sidewalls 1412 and 1512 of the body portion 310, respectively. The first pair of bottom opposing ribs 1741 and 1742 may have upper extents 1751 and 1752 positioned evenly (e.g., at the same height or substantially the same height) with the upper extents 1731 and 1732 of the first and second bottom wall portions 1721 and 1722 of the bottom peripheral wall 1720. The bottom piece 1710 may further include a second pair of bottom opposing ribs 1743 and 1744 extending upward from the interior surface 1760 of the bottom portion 1712 and corresponding to a lower portion of the third and fourth sidewalls 1414 and 1514 of the body portion 310, respectively. The second pair of bottom opposing ribs 1743 and 1744 may have upper extents 1753 and 1754 positioned evenly (e.g., at the same height or substantially the same height) with the upper extents 1733 and 1734 of the third and fourth bottom wall portions 1723 and 1674 of the bottom peripheral wall 1720. The apparatus, methods, and articles of manufacture described herein are not limited in this regard.

Figure 17:
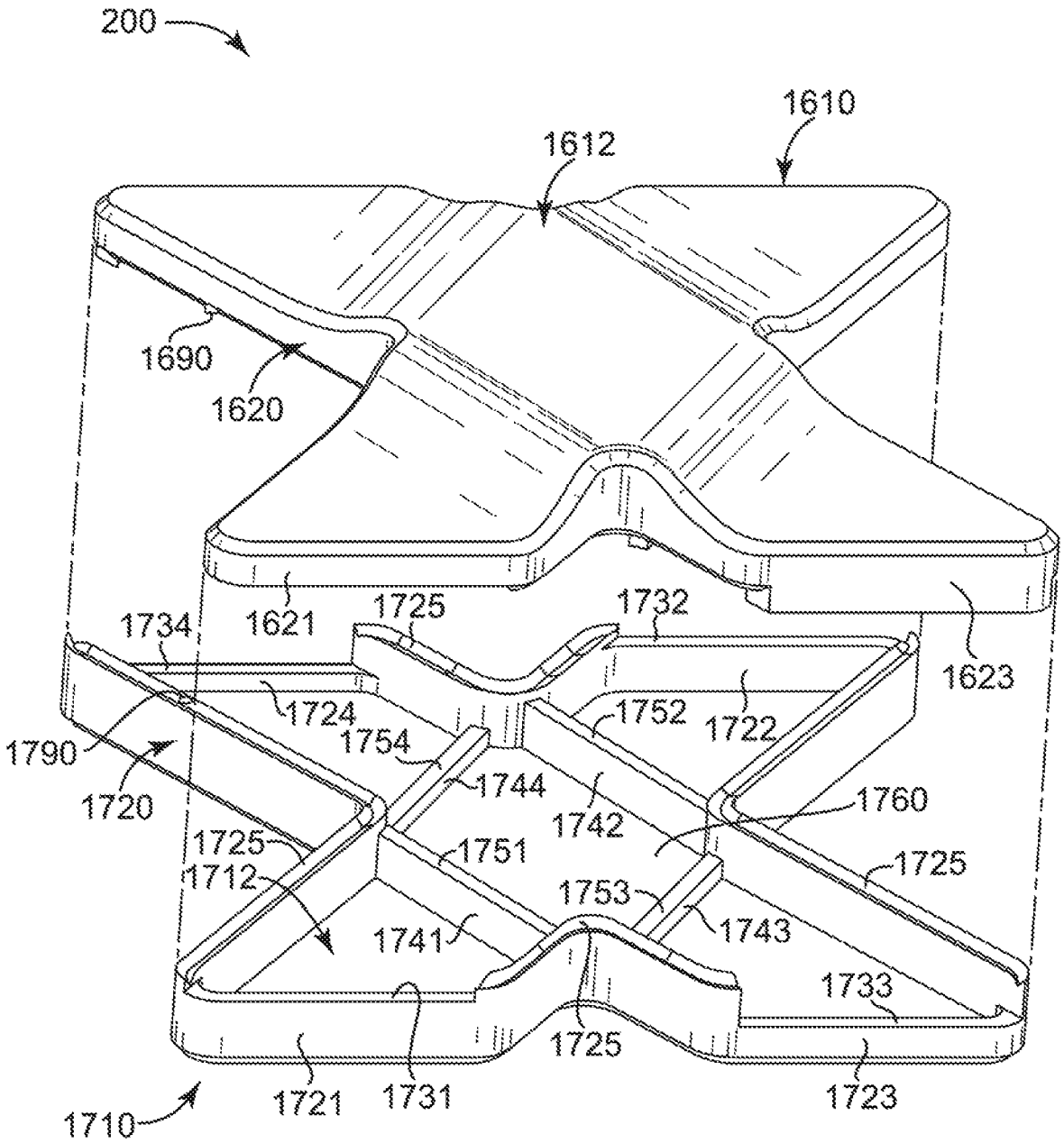
FIG. 17 depicts a top exploded view of the strap connector of FIG. 10.

In one example, as shown in FIGS. 10-17, the top piece 1610 may be joined to the bottom piece 1710 by aligning the top peripheral wall 1620 and the bottom peripheral wall 1720 and receiving the guide portion 1625 of the top peripheral wall 1620 into the guide rail portion 1725 of the bottom peripheral wall 1720. In alternative examples, the guide portion 1625 may be located at the bottom peripheral wall 1720 and the guide rail portion 1725 may be located at the top peripheral wall 1620. Once the top and bottom pieces 1610 and 1710 are joined together, the resulting gap between the first top wall portion 1621 and the first bottom wall portion 1721 may correspond to the first opening 324 of the first channel 322. The resulting gap between the second top wall portion 1622 and the second bottom wall portion 1722 may correspond to the second opening 724 of the first channel 322. The resulting gaps between the first pair of top opposing ribs 1641 and 1642 and the first pair of bottom opposing ribs 1741 and 1742 may correspond to the third opening 1024 and the fourth opening 1124, respectively, of the first channel 322. Additionally, the resulting gap between the third top wall portion 1623 and the third bottom wall portion 1723 may correspond to the first opening 344 of the second channel 342. The resulting gap between the fourth top wall portion 1624 and the fourth bottom wall portion 1724 may correspond to the second opening 744 of the second channel 342. The resulting gaps between the second pair of top opposing ribs 1643 and 1644 and the second pair of bottom opposing ribs 1743 and 1744 may correspond to the third opening 1044 and the fourth opening 1144, respectively, of the second channel 342. Optionally, the guide portion 1625 of the top peripheral wall 1620 may include one or more pegs 1690 (one peg 1690 is shown in FIG. 17) configured to be received in one or more corresponding notches 1790 (one notch shown in FIG. 17) formed in the guide rail portion 1725 of the bottom peripheral wall 1720 so that the top and bottom pieces 1610 and 1710 can be assembled in only a single orientation. Alternatively, the one or more pegs 1690 may be provided at the guide rail portion 1725 and the one or more notches may be provided at the guide portion 1625. The apparatus, method, and articles of manufacture described herein are not limited in this regard.

As described herein, the strap connector 200 may be in an X-shape configuration, which allows the first strap arm portion 320 and the second strap arm portion 340 to extend away from each other as the first strap arm portion 320 and the second strap arm portion 340 extend outward form the body portion 310. Accordingly, the first strap 110 and the second strap 120 may also extend away from each other as the first strap 110 and the second strap 120 pass through the first channel 322 and the second channel 342. The separation of the first strap 110 and the second strap 120 as the first strap 110 and the second strap 120 extend through the first channel 322 and the second channel 342 in combination of with the X-shape configuration of the strap connector 200 providing for the first strap 110 and the second strap 120 to extend away from each other provide for free and unhindered movement of the first strap 110 and the second strap 120 without the first strap 110 and the second strap 120 becoming entangled or interfering with each other. The apparatus, methods, and articles of manufacture described herein are not limited in this regard.

Although FIGS. 1 and 2 show a golf bag 100, the strap system 102, or any component thereof, may be used with any type of bag. Accordingly the strap system 102 is not limited to use with golf bags and may be used with backpacks, duffle bags, suitcases, shoulder bags, infant carriers that are attached to the body, sling-type bags, handbags, or any type of container that may be used to carry one or more objects. The apparatus, methods, and articles of manufacture described herein are not limited in this regard.

Although the strap connector 200 is shown and described herein to have two strap arm portions, a strap connector may include any number of arm portions. For example, a strap connector may include more than two strap arms portions or less than two strap arm portions to accommodate for more or less straps. The apparatus, methods, and articles of manufacture described herein are not limited in this regard.

The strap connector 200 may be manufactured from any material, such as metal, wood, composite materials, and/or one or more plastic materials. In one example, the strap connector 200 may be constructed from a rigid or substantially rigid plastic material. The strap connector 200 may be manufactured in two or more parts that may be bonded together to form the strap connector 200. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A strap connector comprising:

a body portion;

a first strap arm portion extending from the body portion, the first strap arm portion having a first channel extending through the body portion and configured to receive a first strap; and a second strap arm portion extending from the body portion transverse to the first strap arm portion, the second strap arm portion having a second channel extending through the body portion and configured to receive a second strap, wherein the first channel is vertically offset from the second channel such that the first channel extends through the body portion below or above the second channel, and wherein the first strap and the second strap are able to freely move relative to each other without contacting each other inside the strap connector.

2. A strap connector as defined in claim 1, wherein the first channel has a first opening at one end of the first strap arm portion and a second opening at an opposite end of the first strap arm portion, and wherein the first channel extends from the first opening to the second opening.

3. A strap connector as defined in claim 1, wherein the second channel has a first opening at one end of the second strap arm portion and a second opening at an opposite end of the second strap arm portion, and wherein the second channel extends from the first opening to the second opening.

4. A strap connector as defined in claim 1, wherein the body portion includes a center portion between the first channel and the second channel, the center portion configured to separate the first channel and the second channel.

5. A strap connector as defined in claim 1, wherein the body portion includes an interior space shared by the first and second channels.

6. A strap connector as defined in claim 1, wherein the first strap arm portion and the second strap arm portion define an X-shape configuration.

7. A strap connector comprising:

a body portion;

a first strap arm portion extending from the body portion, the first strap arm portion having a first channel extending through the body portion and configured to receive a first strap; and a second strap arm portion extending from the body portion opposite the first strap arm portion, the second strap arm portion having a second channel extending through the body portion and configured to receive a second strap, wherein the first channel has a first opening at one end of the first strap arm portion and a second opening at an opposite end of the first strap arm portion, wherein the second channel has a first opening at one end of the second strap arm portion and a second opening at an opposite end of the second strap arm portion, and wherein a vertical position at which the first and second openings of the first channel are located on the first strap arm portion is different than a vertical position at which the first and second openings of the second channel are located on the second strap arm portion.

8. A strap connector as defined in claim 7, wherein the first channel has a third opening at an interior sidewall of the body portion and a fourth opening at an opposite interior sidewall of the body portion, and wherein the third and fourth openings are aligned with the first and second openings of the first channel along a longitudinal direction from the one end of the first strap arm portion to the opposite end of the first strap arm portion.

9. A strap connector as defined in claim 7, wherein the second channel has a third opening at an interior sidewall of the body portion and a fourth opening at an opposite interior sidewall of the body portion, and wherein the third and fourth openings are generally aligned with the first and second openings of the second channel along a longitudinal direction from the one end of the second strap arm portion to the opposite end of the second strap arm portion.

10. A strap connector as defined in claim 7, wherein the first channel is configured to receive the first strap and the second channel is configured to receive the second strap such that the first strap and the second strap are suspended inside the body portion at different vertical positions.

11. A strap connector as defined in claim 7, wherein the first channel is configured to receive the first strap and the second channel is configured to receive the second strap such that the first strap and the second strap freely move relative to each other without contacting each other inside the body portion.

12. A strap connector as defined in claim 7, wherein the first strap arm portion and the second strap arm portion define an X-shape configuration.

13. A strap connector as defined in claim 7 further comprising a top piece and a bottom piece coupled to the top piece, wherein the top piece defines an upper half of the strap connector and the bottom piece defines a lower half of the strap connector.

14. A strap system of a golf bag, comprising:

a first strap;

a second strap; and a strap connector comprising:

a body portion;

a first strap arm portion extending diagonally from the body portion, the first strap arm portion having a first channel extending through the body portion and configured to receive the first strap; and a second strap arm portion extending diagonally from the body portion opposite the first strap arm portion, the second strap arm portion having a second channel extending through the body portion and configured to receive the second strap, wherein the first channel is vertically offset from the second channel such that the first strap and the second strap are suspended inside the body portion at different vertical positions, and wherein the first strap and the second strap freely move relative to each other without contacting each other inside the strap connector.

15. A strap system as defined in claim 14, wherein the first channel has a first opening at one end of the first strap arm portion and a second opening at an opposite end of the first strap arm portion, and wherein the first opening is vertically aligned with the second opening such that the first and second openings visually coincide if the first strap arm portion is viewed in a longitudinal direction from the one end to the opposite end.

16. A strap system as defined in claim 14, wherein the second channel has a first opening at one end of the second strap arm portion and a second opening at an opposite end of the second strap arm portion, and wherein the first opening is vertically aligned with the second opening such that the first and second openings visually coincide if the second strap arm portion is viewed in a longitudinal direction from the one end to the opposite end.

17. A strap system as defined in claim 14, wherein the first channel is entirely separate from the second channel and the first channel extends through the body portion below or above the second channel.

18. A strap system as defined in claim 14, wherein the strap connector includes a rigid material and an X-shape configuration.

* * * * *